US009344802B2

(12) United States Patent
Suzuki et al.

(10) Patent No.: US 9,344,802 B2
(45) **Date of Patent: *May 17, 2016**

(54) INFORMATION PROVIDING SYSTEM

(71) Applicant: Field System, Inc., Tokyo (JP)

(72) Inventors: Hiroshi Suzuki, Tokyo (JP); Ichiro Okuyama, Tokyo (JP); Takashige Tsukuma, Tokyo (JP); Yoshimaru Maruno, Tokyo (JP)

(73) Assignee: Field System, Inc., Shibuya-Ku Tokyo (JP)

( * ) Notice: Subject to any disclaimer, the term of this patent is extended or adjusted under 35 U.S.C. 154(b) by 326 days.

This patent is subject to a terminal disclaimer.

(21) Appl. No.: 13/924,539

(22) Filed: Jun. 22, 2013

(65) Prior Publication Data

US 2013/0279699 A1 Oct. 24, 2013

Related U.S. Application Data

(63) Continuation-in-part of application No. 11/994,277, filed as application No. PCT/JP2005/014561 on Aug. 9, 2005, now Pat. No. 8,494,176.

(30) Foreign Application Priority Data

Jun. 28, 2005 (JP) ..... 2005-187934

(51) Int. Cl.
*H04H 20/88* (2008.01)
*H04H 20/47* (2008.01)
(Continued)

(52) U.S. Cl.
CPC ..... *H04R 5/04* (2013.01); *H04R 27/00* (2013.01); *H04R 2420/07* (2013.01); *H04R 2499/11* (2013.01)

(58) Field of Classification Search
None
See application file for complete search history.

(56) References Cited

U.S. PATENT DOCUMENTS

RE31,735 E * 11/1984 Davidson ..... H04N 7/165 380/235
4,991,207 A * 2/1991 Shiraishi ..... H04K 1/02 370/312

(Continued)

FOREIGN PATENT DOCUMENTS

CN 101218768 A 7/2008
EP 1906696 A1 4/2008

(Continued)

OTHER PUBLICATIONS

"Recommended Standard-232 (RS-232)," downloaded from www.businessdictionary.com on Dec. 2, 2010.

(Continued)

*Primary Examiner* — Thang Tran
(74) *Attorney, Agent, or Firm* — JTT Patent Services, LLC; Gerald T. Peters

(57) ABSTRACT

An information providing system 1 according to an embodiment of the present invention includes an acoustic signal transmitter 10 for transmitting data in the form of sound waves, a portable telephone 20 serving as an acoustic signal receiver (terminal) for receiving the sound waves and reproducing the data, and a server 50 connected through the Internet 40 to the acoustic signal transmitter 10. The acoustic signal transmitter 10 may transmit the data as sound waves in one-way fashion at a timing determined by the acoustic signal transmitter 10 without reliance on transmission control signals or the like received from the acoustic signal receiver 20. The data which is transmitted as sound waves may employ data frame(s) which may contain information for error detection.

29 Claims, 5 Drawing Sheets

(51) Int. Cl.

| | |
|---|---|
| ***H04R 5/04*** | (2006.01) |
| ***H04R 27/00*** | (2006.01) |

(56) References Cited

U.S. PATENT DOCUMENTS

| | | | | |
|---|---|---|---|---|
| 5,119,397 | A * | 6/1992 | Dahlin | H04W 72/02 340/7.42 |
| 5,408,698 | A * | 4/1995 | Serizawa | H03G 3/3052 375/345 |
| 5,884,259 | A | 3/1999 | Bahl et al. | |
| 6,130,859 | A * | 10/2000 | Sonnenschein | H04B 13/02 340/850 |
| 6,385,581 | B1 * | 5/2002 | Stephenson | H04M 3/568 704/258 |
| 6,519,560 | B1 * | 2/2003 | Spicer | G10L 19/0018 704/231 |
| 6,567,397 | B1 | 5/2003 | Campana et al. | |
| 8,494,176 | B2 * | 7/2013 | Suzuki | H04B 11/00 381/150 |
| 2003/0125957 | A1 | 7/2003 | Puterbaugh et al. | |
| 2003/0212549 | A1 | 11/2003 | Steentra et al. | |
| 2004/0073429 | A1 | 4/2004 | Naruse | |
| 2004/0210329 | A1 * | 10/2004 | Chen | G10L 19/005 381/94.5 |
| 2005/0219068 | A1 | 10/2005 | Jones et al. | |
| 2005/0226274 | A1 | 10/2005 | Kwon et al. | |
| 2006/0154623 | A1 * | 7/2006 | Chen | H04M 1/03 455/116 |
| 2007/0104285 | A1 * | 5/2007 | Chan | H04L 1/0009 375/267 |
| 2008/0243491 | A1 | 10/2008 | Matsuoka | |
| 2009/0067292 | A1 * | 3/2009 | Matsuoka | H04B 7/0613 367/137 |
| 2009/0233582 | A1 | 9/2009 | Suzuki et al. | |
| 2013/0010979 | A1 | 1/2013 | Takara et al. | |

FOREIGN PATENT DOCUMENTS

| | | | |
|---|---|---|---|
| EP | 1947793 | A1 | 7/2008 |
| JP | 2002-341865 | A | 11/2002 |
| JP | 2003-186500 | A | 7/2003 |
| JP | 2004-179956 | A | 6/2004 |
| JP | 2005-122641 | A | 5/2005 |
| JP | 382224 | B1 | 9/2006 |
| JP | 3834579 | B1 | 10/2006 |
| JP | 2007-104598 | A | 4/2007 |
| JP | 2008-129078 | A | 6/2008 |
| JP | 4295781 | B2 | 7/2009 |
| WO | 0245286 | A2 | 6/2002 |
| WO | 2005055566 | A1 | 6/2005 |
| WO | 2007/000829 | A1 | 4/2007 |
| WO | 2007/043376 | A1 | 4/2007 |
| WO | 2011/118018 | A1 | 9/2011 |

OTHER PUBLICATIONS

"Recommended Standard-232 (RS-232)—Glossary Entry," downloaded from www.mobile-phone-directory.org on Dec. 2, 2010, p. 1.

"What is RS-232," downloaded from www.wisegeek.com/what-is-rs-232.htm on Dec. 2, 2010, pp. 1-3.

U.S. Appl. No. 11/994,277, having idnetical inventorship and assigned to the same assignee as in the present case (Field System, Inc.), filed Dec. 28, 2007, published as US 2009/0233582 A1 on Sep. 17, 2009, issued as U.S. Pat. No. 8,494,176 on Jul. 23, 2013, and which is the national stage of PCT/JP2005/014561, which was filed on Aug. 9, 2005 and was published as WO 2007/000829 A1 on Apr. 1, 2007.

U.S. Appl. No. 13/620,748 having overlapping inventorship and assigned to the same assignee as in present case (Field System, Inc.), filed Sep. 15, 2012, published as 2013/0010979 A1 on Jan. 10, 2013, received a Notice of Allowance on Sep. 19, 2013, and which is a "bypass" continuation-in-part of PCT/JP2010/055335, which was filed on Mar. 26, 2010 and was published as WO 2011/118018 A1 on Sep. 29, 2011.

International Search Report in International Application No. PCT/JP2005/014561, of which U.S. Appl. No. 11/994,277, the parent of present application, was the national stage. (Included at the back of WO 2007/000829 A1, attached hereto).

Written Opinion in International Application No. PCT/JP2005/014561, of which U.S. Appl. No. 11/994,277, the parent of present application, was the national stage.

International Search Report in International Application No. PCT/JP2010/055335, of which related copending U.S. Appl. No. 13/620,748 is a "bypass" continuation-in-part. (Included at back of WO 2011/118018 A1, attached hereto).

Written Opinion in International Application No. PCT/JP2010/055335, of which related copending U.S. Appl. No. 13/620,748 is a "bypass" continuation-in-part.

RS232, dowloaded Dec. 2, 2010 from www.machine-information-systems.com/RS232.html, pp. 1-2.

* cited by examiner

FIG. 3

| | | | preamble | | | SOF | type | length |
|---|---|---|---|---|---|---|---|---|
| 1 | data1 | data2 | data3 | data4 | data5 | data6 | data7 | CRC |
| 2 | data8 | data9 | data10 | data11 | data12 | data13 | data14 | CRC |
| 3 | data15 | data16 | data17 | data18 | data19 | data20 | data21 | CRC |
| 4 | data22 | data23 | data24 | data25 | data26 | data27 | data28 | CRC |
| 5 | data29 | data30 | data31 | data32 | data33 | data34 | data35 | CRC |
| 6 | data36 | data37 | data38 | data39 | data40 | data41 | data42 | CRC |
| 7 | data43 | data44 | data45 | data46 | data47 | data48 | data49 | CRC |
| 8 | data50 | data51 | data52 | data53 | data54 | data55 | data56 | CRC |
| 9 | data57 | data58 | data59 | data60 | data61 | data62 | data63 | CRC |
| 10 | data64 | data65 | data66 | data67 | data68 | data69 | data70 | CRC |
| 11 | data71 | data72 | data73 | data74 | data75 | data76 | data77 | CRC |
| 12 | data78 | data79 | data80 | data81 | data82 | data83 | data84 | CRC |
| 13 | data85 | data86 | data87 | data88 | data89 | data90 | data91 | CRC |
| 14 | data92 | data93 | data94 | data95 | data96 | data97 | data98 | CRC |
| 15 | data99 | data100 | data101 | data102 | data103 | data104 | data105 | CRC |
| 16 | data106 | data107 | data108 | data109 | data110 | data111 | data112 | CRC |

| | Total number of bits: | total time |
|---|---|---|
| 16 rows | 1024 | 42.66ms |

INFORMATION PROVIDING SYSTEM

CROSS-REFERENCE TO RELATED APPLICATIONS, PRIORITY CLAIMS, AND INCORPORATION BY REFERENCE

This application is a continuation-in-part of and claims benefit of priority under 35 USC 120 to copending U.S. patent application Ser. No. 11/994,277, entitled "Information Providing System", filed 28 Dec. 2007, which is the national stage of International Patent Application No. PCT/JP2005/014561, entitled "Information Providing System", filed 9 Aug. 2005; and further claims benefit of priority under 35 USC 119(a)-(d) to Japanese patent application Ser. No 2005-187934, entitled "Information Providing System", filed 28 Jun. 2005, the contents of all of which applications are incorporated herein in their entireties by reference.

FIELD OF THE INVENTION

The present invention relates to an information providing system in which data is transmitted from an acoustic signal transmitter in the form of sound waves to a terminal such as a portable telephone or other such acoustic signal receiver.

BACKGROUND

Systems for providing information to a terminal have been proposed conventionally.

For example, in radio and television broadcasting, teletext broadcasting for superimposing (multiplexing) text code and graphic information as well as information related to broadcast programs and so forth on a broadcast signal, and for providing information to a television receiver and radio receiver by adding these to program content, has been carried out.

Information has been provided to portable radio and television devices by superimposing digitized information on vacant frequencies within the assigned channel range in radio broadcasts, in high-frequency domains of subcarriers used in stereophonic broadcasts, and within the blank scanning lines which are present between vertical synchronization and program image content in television broadcasts.

Systems for providing information to portable telephones by using a portable telephone with a camera function to capture a two-dimensional code such as a QR code (registered trademark) which may be printed or displayed on a display, and for deciphering such codes, have already been put into practical use.

Such two-dimensional codes may include information such as URLs and product descriptions in coded form, so as to allow the user of the portable telephone to display information on the display of the portable telephone by reading the two-dimensional code. Where such a portable telephone has Internet access functionality, a website may be accessed by reading the URL, permitting information to be downloaded and displayed.

However, with the aforementioned conventional teletext broadcasting systems, existence of a large broadcast station or other such facility is required so that the digital information can be superimposed on the television or radio electromagnetic waves. Therefore, cost is high, and information cannot readily be provided to the terminal.

With regard to methods involving photograph capture of QR codes, these obviously are impossible to implement where the portable telephone terminal does not have a camera. Furthermore, even where the terminal is equipped with a camera, because the user must move the imaging unit of the portable telephone to a position at which the QR code can be recognized, which is not an easy matter when holding the portable telephone by hand, such methods are inconvenient in practice. For example, to correctly image and recognize the QR code, the QR code must be positioned at a predetermined size within the center of the photographed image while in a focused state, which is a very difficult task for beginners and those not familiar with the equipment.

There has therefore been an unsatisfied need for an information providing system that would address the above deficiencies in the conventional technology.

SUMMARY OF THE INVENTION

In order to solve the above problems, an information providing system according to an embodiment of the present invention may include an acoustic signal transmitter that converts data to sound waves and that transmits the sound waves. The information providing system may further include an acoustic signal receiver (terminal) that receives the sound waves and reproduces the data. The data may be transmitted as sound through air serving as a medium from the acoustic signal transmitter to the acoustic signal receiver.

The transmission frequency of the sound waves (sound pressure vibration) may be chosen so as to be a frequency that is within a range of frequencies reproducible by a speaker and that is within a range of frequencies receivable by a microphone. The transmission frequency of the sound pressure vibration may be chosen so as to be a frequency within a higher half of a range of frequencies audible by a typical human being.

The acoustic signal transmitter may include computing means serving as sound code generator for generating a sound code. The acoustic signal transmitter may include a speaker or other such transducer for transducing the sound code so as to create sound pressure vibrations and transmit the sound pressure vibrations. The sound code may comprise at least one data frame. The at least one data frame may include cyclic redundancy check information or other such information for error detection. The at least one data frame may include at least one preamble for synchronizing timing. The at least one data frame may include information identifying a beginning of the data frame. The at least one data frame may include information identifying data type; e.g., information for limiting receipt of the data to at least one specific individual. The at least one data frame may include information identifying a length of the sound code. The sound code may be subjected to scrambling to prevent the apparent frequency of the sound from being significantly lower than the nominal frequency thereof.

The acoustic signal transmitter may include a digital-to-analog converter. The acoustic signal transmitter may include an analog signal creator. The analog signal creator may create an analog signal by using orthogonal frequency-division multiplexing to digitally modulate a carrier wave based on the sound code.

The acoustic signal transmitter may transmit the sound pressure vibration in one-way fashion at a timing determined by the acoustic signal transmitter without reliance on a transmission control signal received from the acoustic signal receiver. The acoustic signal transmitter may transmit the sound pressure vibration cyclically in repetitive fashion. The transmission time per iteration of the cyclically repeated transmission as calculated based on a transmission frequency and a data length may be made short enough to cause the sound pressure vibration to be of satisfactorily low perceptibility to a human listener and/or short enough to have a reasonable likelihood of being received with satisfactory reliability by an acoustic signal receiver whose physical relationship with the acoustic signal transmitter may be changing as it is carried and moved about by its human owner. For example, the transmission time of the data frame(s) may be chosen so as to be not more than 999 milliseconds, so as to be not more than 682.66 milliseconds, or so as to be not more than a similarly suitable time. The acoustic signal transmitter may carry out masking to cause the sound pressure vibration to be of reduced psychoacoustic perceptibility to a human listener. The masking may be carried out by adjusting transmission timing based on a detected ambient sound signal; e.g., based on a rising edge or other feature in a detected ambient sound waveform.

An acoustic signal receiver (terminal) according to an embodiment of the present invention may receive data transmitted as sound pressure vibration by an acoustic signal transmitter in an information providing system. The acoustic signal receiver (terminal) may include a microphone for receiving the sound pressure vibration and converting it to an electrical signal. The acoustic signal receiver (terminal) may include computing means serving as sound code decoder for decoding a sound code including at least one data frame present in the electrical signal. The acoustic signal receiver (terminal) may perform error checking based on information for error detection present in the at least one data frame. The acoustic signal receiver (terminal) may perform descrambling on the electrical signal, this descrambling being the inverse of scrambling that may have been performed by the acoustic signal transmitter to prevent the apparent frequency of transmitted sound from being significantly lower than the nominal frequency thereof.

An information providing method according to an embodiment of the present invention allows data to be transmitted in the form of sound waves. The method may include generating a sound code. The sound code may comprise at least one data frame. The at least one data frame may include information for error detection. The method may include creating an analog signal based on the sound code. The method may include transducing the analog signal at an acoustic signal transmitter to create a sound pressure vibration and transmitting the sound pressure vibration. The method may include receiving the sound pressure vibration at an acoustic signal receiver and reproducing the data by decoding the sound code in the sound pressure vibration.

A computer program according to an embodiment of the present invention may be executed by computing means; e.g., by computing means at an acoustic signal receiver or other such terminal for receiving data transmitted in the form of a sound waves from an acoustic signal receiver transmitter in an information providing system. The program may cause the computing means of the terminal to execute program steps for causing a microphone of the acoustic signal receiver to receive and convert sound pressure vibration to an electrical signal; and for causing reproduction of the data by decoding of the electrical signal.

The information providing system may further include an electromagnetic wave broadcast facility for broadcasting television, radio, or other such electromagnetic broadcasts. The electromagnetic wave broadcast facility may include computing means for creating a sound code based on the data and superimposing the sound code on a broadcast electromagnetic signal. The electromagnetic wave broadcast facility may include an electromagnetic wave transmission antenna for transmitting the electromagnetic wave broadcast signal as electromagnetic waves. In such case, the acoustic signal transmitter preferably includes an electromagnetic wave antenna for receiving the electromagnetic signal, and a speaker or other such transducer for causing the sound code superimposed on the broadcast electromagnetic signal to be transduced and transmitted as sound pressure vibration when the broadcast electromagnetic signal is reproduced. In such an embodiment, it is preferred that the broadcast signal on which the sound code is superimposed be configured so as to permit an analog signal to be created based on the sound code, and the analog signal to be transduced to create a sound pressure vibration by which the sound code can be transmitted from a speaker of a broadcast receiver, when the broadcast signal is received and reproduced by the broadcast receiver The information providing system, information providing method, acoustic signal transmitter, acoustic signal receiver (terminal), broadcast facility, and computer program in accordance with various embodiments of the present invention make it possible to cause data to be conveyed in the form of sound waves, and make it possible to do so at low cost, since efficient use is made of existing equipment and facilities.

Other embodiments, systems, methods, features, and advantages of the present invention will be or become apparent to one with skill in the art upon examination of the following drawings and detailed description. It is intended that all such additional systems, methods, features, and advantages be included within this description, be within the scope of the present invention, and be protected by the accompanying claims.

BRIEF DESCRIPTION OF THE DRAWINGS

Many aspects of the invention can be better understood with reference to the following drawings. The components in the drawings are not necessarily to scale, emphasis instead being placed upon clearly illustrating the principles of the present invention. Moreover, in the drawings, like reference numerals designate corresponding parts throughout the several views.

FIG. 3 is a view showing exemplary data structure of the sound code in accordance with the first embodiment.

DETAILED DESCRIPTION

Figure 1:
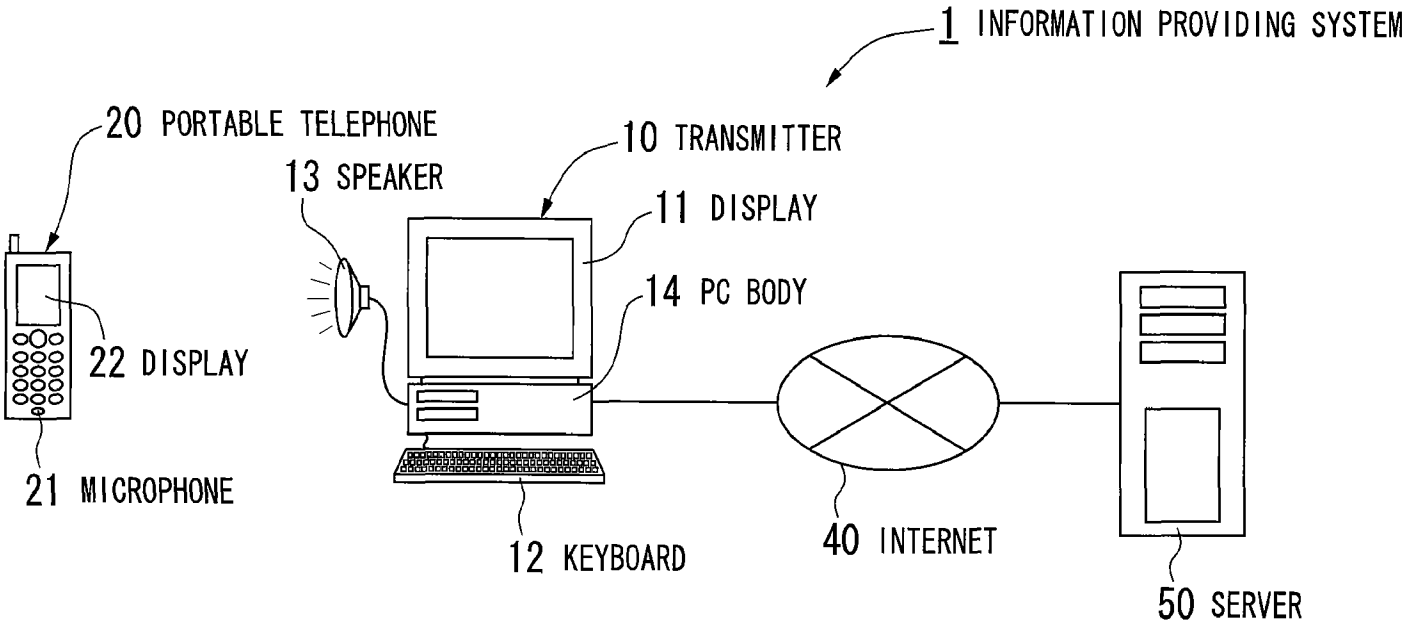
FIG. 1 is a view schematically showing exemplary configuration of an information providing system 1 according to a first embodiment.

Embodiments of the present invention will now be described with reference to the drawings. An information providing system according to one or more embodiments of the present invention permits information (data) such as message(s) to be encoded in a form suitable for transmission in air (sound code), permits the coded data to be transmitted from an acoustic signal transmitter as sound waves (sound pressure vibration) from a speaker so as to be directed toward a portable telephone or other such terminal or the like serving as acoustic signal receiver, and permits the sound pressure vibration to be received by way of a microphone at the acoustic signal receiver (terminal) and thereafter decoded so that the information which was transmitted from the transmitter may be reproduced at the receiver.

An information providing system in accordance with one or more embodiments may be such that the information is transmitted as sound waves (sound pressure vibration) through air serving as medium from the transmitter to the receiver (terminal). Note that such transmission may occur in one-way fashion, e.g., from speaker or other such transducer of the transmitter to microphone or other such transducer of the receiver (terminal). Because such transmission occurs in one-way fashion, transmission by the transmitter preferably occurs at a timing determined by the acoustic signal transmitter without reliance on any sort of transmission control signal or the like received from the acoustic signal receiver.

To improve reliability of acoustic transmission of data through air in potentially noisy environments, the sound code transmitted in some embodiments may employ a data frame structure which may include information for error detection and/or correction. Transmission time may be chosen as appropriate so as to be long enough to transmit a suitable amount of data but not so long as to significantly increase perceptibility to humans and/or significantly impair reliability of transmission in situations where portable telephones or other terminals acting as acoustic signal receivers may be brought into changing acoustic relationship with the speaker or other such acoustic signal transmitter as the acoustic signal receiver is moved about by its human owner. Employment of a high frequency band, e.g., in the upper half of the range of frequencies audible to a typical human being, is preferred in some embodiments, since it may increase the amount of data that can be sent in a short time or reduce the amount of time to send a given amount of data, such shorter transmission times increasing reliability of transmission and decreasing perceptibility to human listeners, and since higher frequencies may tend to be less easily perceived by human listeners than lower frequencies. Masking, e.g., in which transmission of data is timed to coincide or nearly coincide with a feature such as a rising edge in a waveform of an ambient sound detected or otherwise known to exist in the environment of the acoustic signal transmitter, may be employed to make the audio signal less noticeable to human beings.

First Embodiment

FIG. 1 is a view schematically showing a configuration of an information providing system 1 according to the present embodiment. As shown in FIG. 1, the information providing system 1 comprises an acoustic signal transmitter 10 for transmitting information in the form of sound pressure vibration, a portable telephone 20 serving as a terminal and acoustic signal receiver for receiving the information, and a server 50 connected through the Internet 40 to the transmitter 10. The transmitter 10 comprises a keyboard 12 serving as an input means, a display 12, a speaker 13 or other such transducer for converting electrical signals to sound, and a personal computer (PC) body 14 connected thereto. Note that in the present specification and attached drawings, the term "PA" (which may be thought of as an abbreviation for "public address", as in a public address system, but which should not be construed as being limited thereto) is used more or less interchangeably with the term "speaker", these both referring to an electrical acoustic loudspeaker or the like, or to the audio content transduced thereby and transmitted therefrom.

Although not shown, a microprocessor or other such arithmetic unit serving as computing means for performing various calculations and control; a memory used as a work area in calculation; and a storage device (hard disc) for storing various data, programs, and the like, may be present at PC body 14.

The portable telephone 20 includes a microphone 21 for picking up sound from the speaker 13, and a display 22. Although not shown, a processor serving as a computing means for performing various calculations and control, and a memory, may be present at portable telephone 20.

The transmitter 10 of the information providing system 1 might, for example, be installed in any of a wide variety of commercial establishments such as department stores, supermarkets, shopping areas, movie theaters, amusement parks, amusement establishments, and the like. Information which has been converted to sound pressure vibration may be transmitted in the form of sound pressure vibration information alone from speaker 13, or may be superimposed on other sounds such as voice or music being played or announcements being made at such establishments. A customer visiting the establishment will then be able to obtain information by receiving the sound pressure vibration information using his or her portable telephone 20.

Messages related to products, events, announcements being made by the management of such an establishment, and/or text information such as the URL of a related website, may be provided to the owners of such terminals by way of such information. The customers visiting the establishment can capture such URLs and access the Internet using the Internet function of their terminals, enabling them to acquire more information, directly read for themselves various product descriptions, and so forth.

Of course, the location at which the transmitter is installed can be freely decided by the provider of such information, and it goes without saying that use is not limited to the sorts of establishments mentioned above, it being possible for such a transmitter to be installed as appropriate at any of a number of other sorts of locations. Furthermore, the content of the information to be provided is of course not limited to text information, it being possible to provide information in the form of images and so forth.

A process whereby transmitter 10 might generate coded information (hereinafter referred to as "sound code") to be transmitted in the form of sound pressure vibration toward the portable telephone 20 will now be described in detail.

Figure 2:
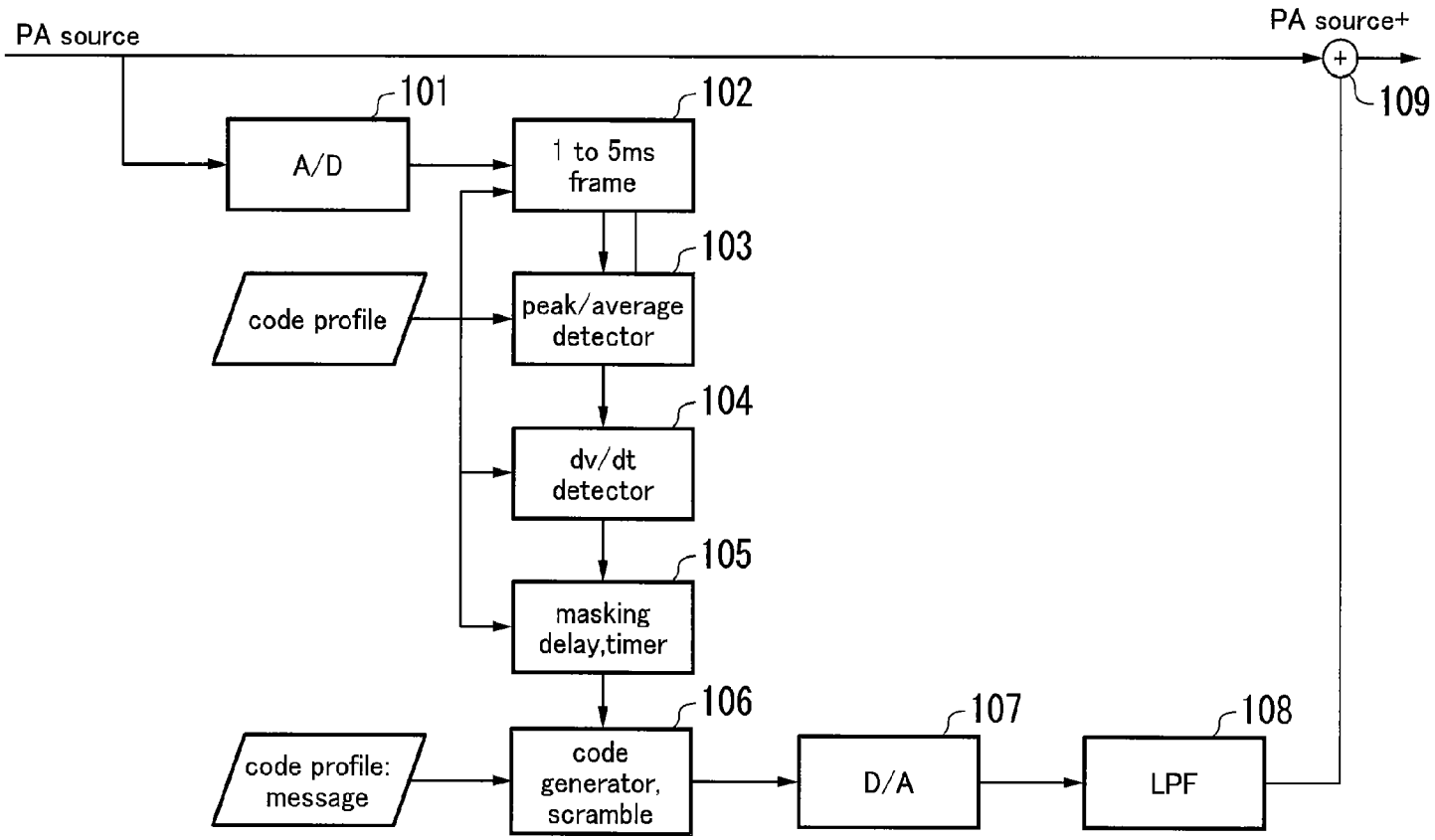
FIG. 2 is a block diagram showing, in conceptual terms, circuitry that might be employed for generating a sound code in accordance with the first embodiment.

Referring now to FIG. 2, this is a block diagram showing, in conceptual terms, circuitry that might be employed for generating such sound code in accordance with the first embodiment.

"PA source" in FIG. 2 refers to audio content which an establishment might cause to be played from PA equipment; e.g., voice or music, on which sound code might be superimposed, which is playing at an establishment at which transmitter 10 is installed. For example, if a music CD is being played from such PA equipment, the audio signal of the music being played might be used as the PA source signal, in which case the PA source signal would be nonexistent (signal level would be flat at zero) when no music is playing.

Such a PA source signal may be used to determine timing with which sound code is generated, sound pressure level, and the like. The PA source signal might be converted to a digital signal by A/D converter circuit 101 and thereafter be sent to frame dividing circuit 102, peak/average detector 103, rise detector 104, and masking circuit 105, where parameters for generating sound code might be determined. Each such circuit might typically establish appropriate parameter(s) affecting the sound code while referencing what is referred to herein as a "code profile".

Such a code profile might be created in advance by having the information provider access server 50 via transmitter 10, at which time the information provider would register or otherwise input to server 50 the information (message(s)) to be transmitted, and might also specify parameters such as signal level and timing as may be required or considered appropriate by the information provider. It is preferred that the information provider be able to easily create such a code profile by accessing server 50 and entering various items in response to prompting with respect to required items which might be displayed on display 11. The code profile which is created might then be transmitted from server 50 to PC body 14, where it may be stored so that it is available to be referenced during creation of sound code as described above.

At frame dividing circuit 102, the PA source signal might be divided into frames which are, e.g., 1 to 5 ms in duration, following which subsequent processing would be performed in units of frames. Although 1 to 5 ms has been mentioned by way of example, a frame size which is appropriate for processing might be set by determining an optimal size based on characteristics of the PA source, the code profile, and so forth.

At peak/average detector 103, the peak value and the average value of the PA source signal amplitude might be detected, and these might then be used as reference parameters for setting sound pressure level(s) when transmitting the sound code.

At rise detector 104, the rising edge of the PA source signal might be detected. The location (time) of the rising edge of the PA source signal may be a location (time) at which it is determined that the sound rapidly becomes large in amplitude, it being possible to use the value detected thereat to achieve a masking effect as will be described below.

At masking circuit 105, parameter(s) for causing sound code to be transmitted at timing such as will produce good masking effect might be set based on, for example, the aforementioned rising edge of the PA source signal. "Masking" refers to a psychoacoustic effect whereby a soft sound (signal of low sound pressure amplitude) is perceived to be drowned out, i.e., "masked," by a loud sound (signal of high sound pressure amplitude). For example, since it is preferred that the sound code in the present embodiment be transmitted at around 12 kHz, parameter(s) would be set so as to cause the sound code to be transmitted with a timing such as will produce good masking effect in such frequency band, as described in further detail below.

Subsequently, at code generating circuit 106, the information (message(s)) contained in the code profile is coded based on the parameters obtained as above, and the sound code is generated. Furthermore, at code generating circuit 106, scramble processing might be performed during code generation. Scramble processing might, for example, employ pseudorandomization so as to prevent the signal from attaining a value of either 0 or 1 for an extended period of time. As described in more detail below, because some embodiments of the present invention may employ Non Return to Zero (NRZ) modulation, for example, this may cause apparent frequency of the signal to be reduced when the signal assumes a value of either 0 or 1 continuously over an extended period of time. To avoid this, scramble processing might be performed so as to cause the frequency of occurrence of signal values of 0 and 1 to be made as close as possible to one-to-one.

Frequency band of the sound code which is generated might be determined based on the following considerations. First, it is preferred that the frequency band be within the operating frequency range of microphone 21 at portable telephone 20 which serves as receiver and within the operating frequency range of speaker 13 at transmitter 10. Based on studies by the present inventors, the input frequency band of microphones present at common portable telephones might be on the order of 50 Hz to 20 kHz, and the output frequency band of common speakers used in PA systems might be on the order of 65 Hz to 20 kHz, or might be on the order of 65 Hz to 17 kHz.

It is preferred that the influence of the sound of the sound code on the original PA source sound be made small. The audible sound range of humans varies among individuals but is said to normally be on the order of from 20 Hz at the low end to somewhere around 15 kHz to 20 kHz at the high end. The frequency range of the fundamental tones from musical instruments is generally understood to be on the order of 30 Hz to 4100 Hz for piano, 10 Hz to 8000 Hz for pipe organ, and 200 Hz to 2650 Hz for violin, and for the human voice, this is generally understood to be on the order of 85 Hz to 1100 Hz.

In the present embodiment, an NRZ signal is used for transmission signal of sound code, and it is possible to transmit data at higher transfer rates for higher clock frequencies, as will be described in further detail below. This being the case, it is preferred that the band employed be as high in frequency as possible so as to permit high data transfer rates.

In view of the above, it is preferred in the present embodiment that the frequency at which the sound code is transmitted be on the order of 12 kHz to 13 kHz, which is toward the high side of the audible frequency range, and is in the upper half of the range of frequencies audible to a typical human. Of course, the sound code may be transmitted at other frequency bands in accordance with the preferences of the information provider. Furthermore, the frequency at which the sound code is transmitted is preferably within the output frequency range of the speaker and the input frequency range of the microphone, and so it is preferred that the frequency at which the sound code is transmitted is selected so as to match the performance of the speaker and the microphone. In particular, when the performance of the speaker that is used is poor, the speaker will have a narrow frequency response range, so the frequency at which the sound code is transmitted should be selected so as to match the narrow frequency response range of the speaker.

Referring to FIG. 3, an exemplary data structure of the sound code will now be described. FIG. 3 shows an exemplary data frame structure which may be employed by the sound code of the present embodiment. The data frame shown in FIG. 3 is provided with, in order: a preamble for synchronizing timing (preamble), a start-of-frame (SOF) identifier identifying the beginning of the frame, a section indicating data type (type), and a section indicating data length (length). Provided thereafter are 16 rows of data, each row of data being composed after the fashion data1, data2, . . . , data7, CRC (described below), such that this one frame is capable of handling 112 bytes of data, not counting CRCs, in the present embodiment.

The "type" may be used to identify information provider(s), limit recipient(s) to specific individual(s), and so forth. Furthermore, the "length" represents the length of the sound code, which is constituted in the present embodiment so as to permit handling of a maximum of 16 of the frames shown in same drawing, or up 2,048 bytes of data, counting CRCs.

"CRC" refers to data appended for error checking and/or correction by means of, for example, a cyclic redundancy check. For example, CRC may in the present embodiment be redundant polynomial code for detection and correction of data errors, the CRC data being appended in advance to transmitted data so that error checking and/or correction can be carried out at the time of reception. Here, such processing is carried out not at the frame level, but instead a CRC is appended and error checking/correction is carried out every 7 bytes, and it is also possible to vary as appropriate the amount of data that is sent with each row.

The sound code generated in this manner may be transmitted with timing as determined by masking circuit 105. For example, in the present embodiment, the time to transmit one frame might be set so as to be 42.66 ms, which would correspond to a transmission time of 682.66 ms for the maximum 16 frames envisioned in the present embodiment. Even when masking based on the rising edge of the waveform at the PA source signal or other ambient sound (including regular broadcast programming serving as ambient signal in an embodiment in which the sound code is superimposed on an electromagnetic broadcast signal as described below) is not carried out, it is preferred to choose a total transmission time that is short enough, e.g., not more than this 682.66 ms, to be of reduced perceptibility to a human listener and/or improved reliability of reception given the fact that the receiver may be in changing acoustic relationship with the transmitter as its human owner moves it about, for example.

Subsequently, at D/A converter circuit 107, the sound code might be NRZ modulated, the modulated encoded signal might be used to digitally modulate a carrier wave, e.g., by means of orthogonal frequency-division multiplexing (OFDM), and this might be converted to an analog signal. Sound pressure level of the sound code is represented by bit values assigned in correspondence to the result of detection performed at peak/average detector 103. The number of bits used to represent sound pressure level may be selected so as to be any appropriate bit size, but bit size in the present embodiment is preferably on the order of 10 to 16 bits. For example, for a bit size of 16 bits, the smallest sound pressure level of 0,1 would be represented as 0000,0x0001, and the largest sound pressure level would be represented as 0000, 0xFFFF.

The sound code which has thus been converted to an analog signal might, for example, take the form of a sine wave whose high frequency component has been cut by low pass filter (LPF) 108.

The analog signal of the sound code having a waveform of such shape might be added to the PA source signal at adder circuit 109, and this might then by transduced by and transmitted from the speaker. At FIG. 2, note that "PA source+" is intended to indicate that the sound code is superimposed on the PA source signal.

Processing for generating the sound code described above might be implemented in the form of software by causing the computing means at transmitter 10 to execute an application stored in the storage device, or such processing might be implemented in the form of hardware by providing dedicated circuitry for performing such processing.

Figure 4:
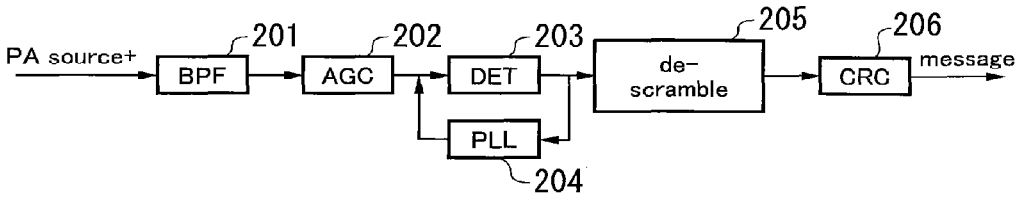
FIG. 4 is a block diagram showing, in conceptual terms, circuitry that might be employed for receiving the sound code in accordance with the first embodiment.

Referring to FIG. 4, processing for receiving sound code at portable telephone 20 serving as terminal for receiving information will now be described. FIG. 4 is a block diagram showing, in conceptual terms, circuitry that might be employed for receiving sound code in accordance with the first embodiment.

The sound of the PA source together with the sound code which is superimposed thereupon is picked up by microphone 21 of portable telephone 20, and is converted to an electrical signal indicated as "PA source+" in FIG. 4. This electrical signal then passes through a bandpass filter (BPF) 201. BPF 201 is configured to cut frequencies other than frequencies in the vicinity of the transmission frequency of the sound code, so that it is primarily only the sound code component of the PA source+signal that is sent to AGC (Automatic Gain control) circuit 202.

AGC circuit 202 is a circuit for automatically adjusting the amplification factor (gain) of the amplifier circuit so as to produce constant output despite fluctuation in the amplitude of the input electrical signal, as a result of which the signal level of the received sound code is adjusted.

The signal is synchronized by DET (detector) 203 and PLL (phase locked loop) circuit 204, as a result of which the original NRZ signal is obtained. Note that if precision of the receiver clock is sufficiently high, PLL circuit 204 may be omitted.

The sound code signal is then sent to descramble circuit 205, where an operation that is the inverse of the scramble processing that was previously performed on the sound code is carried out, as a result of which the sound code is decoded.

The sound code signal is then sent to CRC circuit 206, where errors are detected and/or corrected based on CRC or other such error detection information in the sound code. For example, in the present embodiment, since there is a CRC in every row of the data frame structure shown in FIG. 3, error checking and/or correction at CRC circuit 206 would preferably be performed for every such row of data. Note that what is shown in the drawings and described herein as a "CRC" is not limited to information suitable for performance of a cyclic redundancy check, but may include information permitting any suitable method for detecting and/or correcting errors to be carried out.

The message(s) is/are restored from the sound code decoded in this manner, and is/are displayed on the display 22 of portable telephone 20. Note that the method of presenting restored message(s) to the owner of the terminal is not limited to visual display of restored message(s) on the terminal display, but may include presentation by means of voice or other audio output from a speaker (not shown) of portable telephone 20.

Control and/or processing for receiving the sound code and restoring message(s) might be implemented in the form of software by causing the computing means of portable telephone 20 to execute a predetermined program, or such control and/or processing might be implemented in the form of hardware by providing circuitry for implementing specific functions.

Configuration of an information providing system 1 according to a first embodiment has been described above.

A method of using the present system to transmit information (message(s)) will now be described.

A person ("information provider") who wishes to use the present information providing system to transmit information might first create a code profile. The code profile might be created by accessing server 50 via transmitter 10. The code profile might be created by registering or otherwise inputting to server 50 message(s) to be transmitted, as well as any values which the information provider wishes to specify regarding the timing of transmission, the sound pressure level of the sound code to be transmitted, the transmission frequency, and so forth.

With respect to the timing of transmission, the information provider might specify a timing such that transmission is carried out in continuous fashion ten times every minute (e.g., corresponding to a transmission time of 682.66 ms per instance in a situation where the sound code comprises 16 frames as defined above), or such that transmission is carried out cyclically, repetitively, and/or in endless fashion either continuously or at suitable intervals, such as every ten seconds or the like.

The information provider might then give a command for initiating transmission of the sound code from the transmitter 10, as a result of which the sound code would be generated in the manner described above, and the sound code would be transmitted from speaker 13 of transmitter 10. At this time, when a nonzero PA source signal exists (i.e., music or the like is playing), the audio signal of the sound code would be transmitted such that it is superimposed on the PA source sound; however, when no nonzero PA source signal exists (i.e., music or the like is not playing), only the audio signal of the sound code would be transmitted. Note that profile data such as has been described above may be referred to during creation of the sound code.

In the present embodiment, because the sound code is transmitted at a frequency on the order of 12 kHz, which is toward the high side of the audible sound band for humans, and because transmission time is of duration in units of milliseconds, the sound code is a sound which is barely audible—only being perceptible to humans who are listening very carefully—even when there is no nonzero PA source signal (i.e., even when no music or the like is playing). And when there is a nonzero PA source signal (i.e., when music or the like is playing), because the masking effect may be utilized, the sound of the sound code will be perceived only slightly, if at all, by humans. Note that where it is said that transmission time of the sound code may be in units of milliseconds, it being the convention in the art to refer to such times in units which are grouped every three orders of magnitude in correspondence to placement of commas to separate digits in such numbers, this is intended to mean that transmission time in such case is in units of milliseconds as opposed to seconds or microseconds, or in other words that transmission time is in the range 1 ms to 999 ms, or is not more than 999 ms.

An owner of a portable telephone 20 who desires to receive the sound code might execute a JAVA (registered trademark) or BREW (registered trademark) application for receiving the sound code on the portable telephone 20, which would cause the sound code picked up by microphone 21 to be decoded and so forth so that the transmitted information (message(s)) can be displayed on display 22. If the reception (sensitivity) of portable telephone 20 with respect to the sound code is poor, the sound code might be more reliably received by changing the orientation of portable telephone 20 so as to direct microphone 21 toward speaker 13 or by bringing portable telephone 20 closer to speaker 13.

Customers visiting an establishment where transmission of information is being carried out using sound code might be notified of such fact by means of a bulletin board or similar visual posting in the establishment or by means of voice announcement.

Note that where the message transmitted by way of sound code contains a URL, a customer receiving such sound code message might conveniently access a website or the like at that URL using Internet connectivity functionality (if present) of portable telephone 20 to obtain further information.

Thus, in accordance with the information providing system of the present embodiment described in detail above, information can be provided, at low cost and using existing equipment, to customers visiting an establishment. For example, a microphone for telephone call purposes will already have been built into typical portable telephones which may be used as information receiving terminals (i.e., acoustic signal receivers), and so such devices may easily be made capable of receiving information transmitted via sound code merely by addition of an appropriate application program for implementation of the information providing system.

Second Embodiment

A second embodiment of the present invention will now be described. Whereas the first embodiment concerned an information providing system having a configuration for transmitting sound code from a speaker which is connected to a personal computer, the second embodiment differs therefrom primarily with respect to the fact that the sound code signal (a signal carrying sound pressure vibration information) in the second embodiment is broadcast by being superimposed on television, radio, or other such publicly and/or commercially available broadcasts which may for example be transmitted in the form of electromagnetic waves, the sound code being transmitted in the form of sound pressure vibration from a speaker of a broadcast receiver (which may thus simultaneously serve as an acoustic signal transmitter) which has received the sound code signal in the form of an electromagnetic wave or the like. Description of features of the second embodiment that are similar to corresponding features in the first embodiment will be omitted below, emphasis being placed instead on those aspects that differ from the first embodiment.

Figure 5:
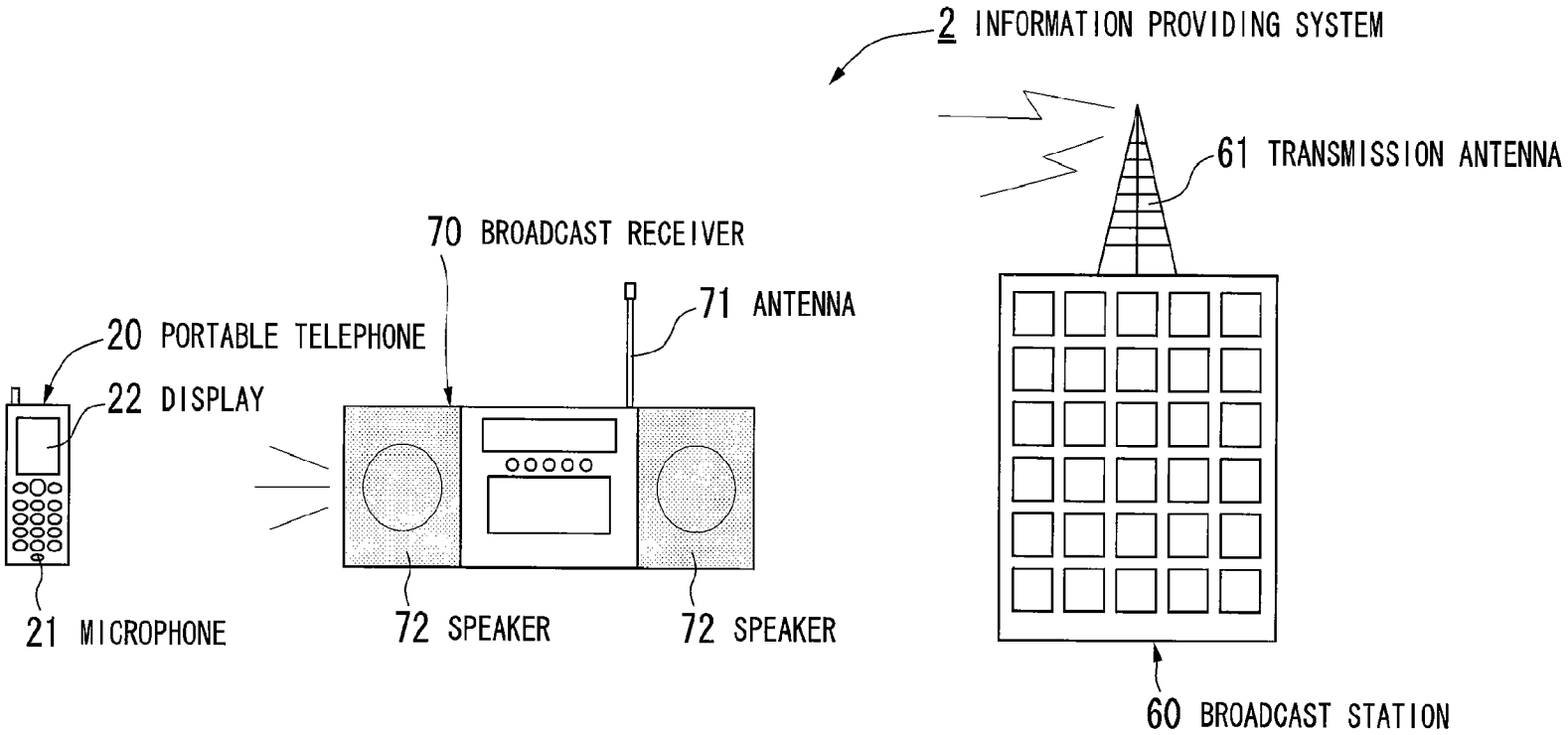
FIG. 5 is a view schematically showing an exemplary configuration of an information providing system 2 according to a second embodiment.

FIG. 5 is a view schematically showing an exemplary configuration of an information providing system 2 according to the second embodiment. In the description which follows, the second embodiment will be described in terms of an example in which radio broadcasts are employed. As shown in FIG. 5, information providing system 2 includes broadcast station 60 which broadcasts radio programming; broadcast receiver 70 for receiving electromagnetic waves and reproducing program content conveyed thereby, as well as for extracting sound code from electromagnetic waves and transmitting the sound code in the form of sound pressure vibration; and portable telephone 20 for receiving the sound pressure vibration.

Broadcast station 60 includes equipment (not shown) for generating electromagnetic waves as well as a transmission antenna 61, and also includes a system (not shown) for generating a code profile as well as a system for generating a sound code and superimposing the sound code on the electromagnetic waves that carry the programming content which is being broadcast. Broadcast receiver 70 includes an antenna 71 for receiving electromagnetic waves and a speaker 72 for reproducing the audio information of the broadcast program (together with the sound code, when present).

In an information providing system 2 having such configuration, program content together with the sound code which is superimposed thereupon is broadcast from broadcast station 60. The code profile might have been created in advance in accordance with the requirements of an advertiser or other such information provider who wishes to transmit information in the form of sound code. Sound code is generated based on the timing of transmission, sound pressure level, frequency, and so forth specified in the code profile, and the sound code is superimposed on the regular program information signal (PA source signal) and is broadcast over a wide area from transmission antenna 61.

Broadcast receiver 70 receives, by way of antenna 71, the electromagnetic waves together with the sound code which is superimposed thereupon, and causes the audio information of the broadcast program to be reproduced from speaker 72 and also causes the audio information of the sound code to be reproduced from speaker 72, i.e., to be transduced and transmitted therefrom in the form of sound pressure vibration.

The broadcast program might contain an announcement to the effect that a URL or other such message is superimposed thereon and broadcast together therewith in the form of sound code. An owner of portable telephone 20 who desires to receive such a message might activate an application for receiving sound code, and then direct microphone 21 of portable telephone 20 toward speaker 72 so as to permit the sound code to be retrieved by portable telephone 20 by way of microphone 21. The retrieved sound code might then be decoded by portable telephone 20, and the message contained in the sound code might be displayed on display 22.

In accordance with the second embodiment which has been described in detail above, it is possible to cause sound code to be broadcast over wide areas using publicly and/or commercially available broadcasts, and to cause sound code to be transmitted in the form of sound pressure vibration at numerous locations by receivers which receive such broadcasts. Furthermore, this can be accomplished by merely adding a simple system for superimposition of the sound code to an existing broadcast facility, permitting the sound code to be transmitted over wide areas with small investment in additional equipment.

The present embodiment can be effectively used to deliver text or other such information to complement or supplement the regular program content which is delivered to viewers/listeners. Furthermore, if URL information is sent in the form of sound code to encourage viewers/listeners to access websites of broadcast programs or website of program sponsors, this can serve as an effective advertising medium.

Although the present embodiment was described in terms of an example in which information providing system 2 was applied in the context of terrestrial radio broadcasts, the present invention may also be applied in the context of terrestrial television broadcasts; furthermore, the present invention is not limited to terrestrial broadcasts but may also be applied in the context of cable television or other such cable broadcasts, or in the context of CS broadcasts, BS broadcasts, or other such satellite broadcasts.

The information providing system according to the present invention has been described in terms of examples presented in the context of first and second embodiments which allow information to be provided to a terminal through a novel method not hithertofore proposed. Furthermore, the information providing system of the present invention makes it possible for information to be provided by effective and efficient use of existing facilities and equipment, making it possible for the information providing system of the present invention to be implemented at low cost.

As described above, embodiments of the present invention make it possible to provide an information providing system in which information is transmitted through air serving as medium from a speaker or other such transducer at a transmitter to a microphone at a portable telephone or other such receiving terminal.

Many variations and modifications may be made to the above-described embodiments of the invention without departing substantially from the spirit and principles of the invention. All such modifications and variations are intended to be included herein within the scope of this disclosure and the present invention and protected by the following claims.

Whereas the present invention has been described in terms of a situation in which PC body 14 and speaker 13 are installed at the same location, speaker 13 may be installed at a location that is removed by some distance from PC body 14.

Furthermore, whereas the present invention was described above in terms of an embodiment in which only one speaker 13 was arranged at transmitter 10 for the sake of simplifying description, there is no objection to causing a plurality of speakers to be arranged when it is desired that the sound code be received at a plurality of locations in an establishment.

Moreover, the receiving terminal is not limited to a portable telephone, but may be any type of terminal so long as it is equipped with microphone(s). For example, this may be a PDA, IC recorder, portable radio, portable television, laptop computer, radio cassette player, video game device, or the like. Furthermore, a special-purpose terminal may be provided for implementing the present invention.

The receiving terminal may be a terminal having a display as described above, or instead of or in addition to a display the terminal may employ a speaker which is arranged so as to permit the owner of the terminal to be notified of information contained in the sound code by reproducing that information by voice or other such audio output. In some embodiments, the terminal need not be a portable terminal, but may be a stationary terminal, it being sufficient in such case that the terminal be equipped with a microphone for picking up the sound of the sound code.

The code profile is not limited to being created by accessing a server, it being possible for a user to alternatively create the code profile at the PC by using an application for creating code profiles which is installed at the PC. Instead of creating the code profile in advance, each parameter may be set in real time when generating the sound code.

Whereas the present invention was described in terms of embodiments in which the sound code was generated by a transmitter installed at a location from which sound code is to be transmitted, it is also possible to cause the sound code to be created in advance and/or at a location other than that from which the sound code is to be transmitted, e.g., by accessing a server or the like, in which case the transmitter which is arranged at the site might merely be made to, at some predetermined timing, transmit (reproduce) sound code created in advance at the same or another location.

Moreover, the transmission frequency of the sound code is not limited to around 12 kHz, it being possible to employ any suitable frequency band. For example, if the performance of the speaker is poor (e.g., preventing sound of frequencies greater than 10 kHz from being properly transmitted), a slightly lower frequency band, e.g., 7 to 8 kHz, might be used. It is also possible to employ a plurality of frequency bands, in which case the transmission frequency of the sound code may be appropriately varied in accordance with frequency characteristics of the PA source signal.

Although the sound code in the embodiment described above employed a data frame structure in which data length was a maximum of 16 frames, each frame containing 16 rows, each row containing 7 bytes of data, this data frame structure was given for illustrative purposes only, it being possible to employ any suitable data frame structure for transmission of the sound code. Note that various other aspects of the data frame structure used for transmission of the sound code may be appropriately changed; for example, the error checking/correcting method and the coding method may be freely chosen as appropriate.

Although a cyclic redundancy check (CRC) was employed in the embodiment described above, any suitable error-checking and/or error-correcting method may be employed. For example, although a CRC check was carried out for each row of data transmitted in the embodiment described above, error-checking and/or error-correction may alternatively or additionally be carried out for each frame of data transmitted.

What is claimed is:

1. An information providing system in which data is transmitted in the form of sound waves, the information providing system comprising:

(a) an acoustic signal transmitter that converts data to a sound pressure vibration and that transmits the sound pressure vibration, wherein the acoustic signal transmitter comprises i. a sound code generator for generating a sound code, the sound code comprising at least one data frame, the at least one data frame including information for error detection;

ii. an analog signal creator for creating an analog signal based on the sound code; and iii. a transducer that transduces the analog signal to create the sound pressure vibration for transmission in air; and (b) an acoustic signal receiver that reproduces the data by receiving the sound code and decoding the at least one data frame; and wherein the acoustic signal transmitter transmits the sound pressure vibration in one-way fashion at a timing determined by the acoustic signal transmitter without reliance on a transmission control signal received from the acoustic signal receiver.

2. The information providing system according to claim 1 wherein the acoustic signal transmitter carries out masking to cause the sound pressure vibration to be of satisfactorily low psychoacoustic perceptibility to a human listener.

3. The information providing system according to claim 1 wherein the acoustic signal transmitter includes computing means that serves as the sound code generator for generating the sound code, and a speaker that serves as the transducer that transduces the analog signal to create the sound pressure vibration; and the acoustic signal receiver includes a microphone for receiving the sound pressure vibration and converting the sound pressure vibration into an electrical signal, and computing means that decodes the sound code in the electrical signal to reproduce the data from the acoustic signal transmitter.

4. The information providing system according to claim 1 further comprising an electromagnetic wave broadcast facility, wherein the broadcast facility superimposes the sound code on an electromagnetic broadcast signal;

wherein the broadcast facility transmits the broadcast signal as an electromagnetic wave; and wherein the broadcast signal on which the sound code is superimposed is configured so as to permit an analog signal to be created based on the sound code, and the analog signal to be transduced to create a sound pressure vibration by which the sound code can be transmitted from a speaker of a broadcast receiver, when the broadcast signal is received and reproduced by the broadcast receiver.

5. The information providing system according to claim 4 wherein masking is carried out by the sound code generator when superimposing the sound code on the electromagnetic broadcast signal so that the sound code which is transmitted from the speaker of the broadcast receiver will be of satisfactorily low psychoacoustic perceptibility to a human listener.

6. An acoustic signal transmitter for transmitting data to an acoustic signal receiver, the acoustic signal transmitter comprising:

a sound code generator for generating a sound code, the sound code comprising at least one data frame, the at least one data frame including information for error detection;

an analog signal creator for creating an analog signal based on the sound code; and a transducer that transduces the analog signal to create a sound pressure vibration for transmission in air.

7. The acoustic signal transmitter according to claim 6 wherein the acoustic signal transmitter transmits the sound pressure vibration in one-way fashion at a timing determined by the sound code generator of the acoustic signal transmitter without reliance on a transmission control signal received from the acoustic signal receiver.

8. The acoustic signal transmitter according to claim 6 wherein a transmission frequency of the sound pressure vibration is a frequency that is within a range of frequencies reproducible by a speaker at the acoustic signal transmitter and that is within a range of frequencies receivable by a microphone at the acoustic signal receiver.

9. The acoustic signal transmitter according to claim 6 wherein a transmission frequency of the sound pressure vibration is a frequency within a higher half of a range of frequencies audible by a typical human being.

10. The acoustic signal transmitter according to claim 6 wherein the analog signal creator creates the analog signal by using orthogonal frequency-division multiplexing to digitally modulate a carrier wave based on the sound code.

11. The acoustic signal transmitter according to claim 6, wherein the analog signal creator comprises a digital-to-analog converter.

12. The acoustic signal transmitter according to claim 6 wherein the sound code is transmitted cyclically in repetitive fashion.

13. The acoustic signal transmitter according to claim 12 wherein a transmission time per iteration of the cyclically repeated transmission as calculated based on a transmission frequency and a data length is short enough to cause the sound code to be of satisfactorily low perceptibility to a human listener.

14. The acoustic signal transmitter according to claim 6 wherein a transmission time of the at least one data frame is not more than 999 milliseconds.

15. The acoustic signal transmitter according to claim 6 wherein a transmission time of the at least one data frame is not more than 682.66 milliseconds.

16. The acoustic signal transmitter according to claim 6 wherein the sound code generator of the acoustic signal transmitter carries out masking to cause the sound code to be of satisfactorily low psychoacoustic perceptibility to a human listener.

17. The acoustic signal transmitter according to claim 16 wherein the masking is carried out by adjusting transmission timing based on a detected ambient sound signal.

18. The acoustic signal transmitter according to claim 16 wherein the masking is carried out by adjusting transmission timing based on a rising edge in a detected ambient sound waveform.

19. The acoustic signal transmitter according to claim 6 wherein the information for error detection is cyclic redundancy check information.

20. The acoustic signal transmitter according to claim 6 wherein the at least one data frame further includes at least one preamble for synchronizing timing.

21. The acoustic signal transmitter according to claim 6 wherein the at least one data frame further includes information identifying a beginning of the data frame.

22. The acoustic signal transmitter according to claim 6 wherein the at least one data frame further includes information identifying data type.

23. The acoustic signal transmitter according to claim 22 wherein the data type information is for limiting receipt of the data to at least one specific individual.

24. The acoustic signal transmitter according to claim 6 wherein the at least one data frame further includes information identifying a length of the sound code.

25. The acoustic signal transmitter according to claim 6 wherein the sound code is subjected to scrambling to prevent an apparent frequency of the sound from being significantly lower than a nominal frequency thereof.

26. An electromagnetic wave broadcast facility, the broadcast facility comprising:

computing means for superimposing a sound code on an electromagnetic broadcast signal serving as source for the sound code which is superimposed thereon, wherein the computing means comprises a sound code generator for generating the sound code, the sound code comprising at least one data frame, the at least one data frame including information for error detection; and a transmission antenna arranged to transmit the broadcast signal as an electromagnetic wave;

wherein the broadcast signal on which the sound code is superimposed is configured so as to permit an analog signal to be created by an analog signal creator based on the sound code, and the analog signal to be transduced by a transducer to create a sound pressure vibration by which the sound code can be transmitted from a speaker of a broadcast receiver that receives the broadcast signal.

27. The electromagnetic wave broadcast facility according to claim 26 wherein the sound code generator of the computing means carries out masking when superimposing the sound code on the electromagnetic broadcast signal so that the sound code which is transmitted from the speaker of the broadcast receiver will be of satisfactorily low psychoacoustic perceptibility to a human listener.

28. An information providing method in which data is transmitted in the form of sound waves, the information providing method comprising:

generating a sound code, the sound code comprising at least one data frame, the at least one data frame including information for error detection;

creating an analog signal based on the sound code;

transducing the analog signal at an acoustic signal transmitter to create a sound pressure vibration that causes the sound code to be transmitted as sound waves through air serving as a medium to an acoustic signal receiver;

receiving the sound pressure vibration at the acoustic signal receiver; and reproducing the data at the acoustic signal receiver by decoding the sound code in the sound pressure vibration;

wherein the acoustic signal transmitter transmits the sound pressure vibration in one-way fashion at a timing determined by the acoustic signal transmitter without reliance on a transmission control signal received from the acoustic signal receiver.

29. The information providing method according to claim 28 wherein the acoustic signal transmitter carries out masking to cause the sound pressure vibration to be of satisfactorily low psychoacoustic perceptibility to a human listener.

* * * * *